United States Patent [19]

Julian

[11] 3,989,152

[45] Nov. 2, 1976

[54] CHILD-RESISTANT LOCKING MEANS FOR A TWIST-ACTION CONTAINER CAP

[75] Inventor: Randall K. Julian, Elberfeld, Ind.

[73] Assignee: Sunbeam Plastics Corporation, Evansville, Ind.

[22] Filed: Feb. 9, 1976

[21] Appl. No.: 656,322

[52] U.S. Cl. ..... 215/216; 215/217; 215/224

[51] Int. Cl.[2] ..... B65D 55/02; B65D 85/56; A61J 1/00

[58] Field of Search ..... 215/216, 217, 224, 218

[56] References Cited

UNITED STATES PATENTS

| | | | |
|---|---|---|---|
| 3,679,084 | 7/1972 | Aronson | 215/217 |
| 3,841,514 | 10/1974 | Montgomery et al. | 215/216 |
| 3,917,097 | 11/1975 | Uhlig | 215/216 |
| 3,941,268 | 3/1976 | Owens et al. | 215/216 |

*Primary Examiner*—George T. Hall
*Attorney, Agent, or Firm*—Henry K. Leonard

[57] ABSTRACT

Child-resistant locking means for a twist-action cap for a container. The locking means has two cooperating parts. There is an abutment on the container near, but spaced radially from, the container neck and a tab on the cap which engages the abutment and prevents retrograde rotation of the cap. The tab is flexed inwardly in order to be moved past the abutment both when the cap is screwed onto the container neck and when it is desired to remove the cap from the container neck.

10 Claims, 7 Drawing Figures

CHILD-RESISTANT LOCKING MEANS FOR A TWIST-ACTION CONTAINER CAP

BACKGROUND OF THE INVENTION

Many child-resistant closures have been developed in recent years, some of them consisting of two cooperating parts, viz. an inner screw-type closure and an outer overcap which can be utilized to turn the inner cap onto the neck of the container but cannot be utilized to remove the cap from the container without special manipulation. These have been relatively expensive because of the necessary two separate parts and the requirement for assembly of those parts. Other types have consisted of single unitary pieces each of them consisting of a cap which is threaded to mate with the threads on the neck of a container in order that it may be screwed downwardly to liquid tight positon and others also unitary in construction but consisting of double skirted elements, the inner skirt having the thread for mating with the container thread and an outer skirt. In these types of containers, the cap usually has one of two cooperating elements which render the cap child-resistant. This may be attached directly to a single skirt cap for cooperation with an element on the container itself or, in a double skirt cap, the child-resistant element is part of the outer skirt and cooperates with an element on the container itself.

Various ways of disengaging the child-resistant elements have been suggested. In some instances, the outer skirt of a two-part cap is lifted to disengage the elements; in others the outer skirt is squeezed inwardly at appropriate places in order to bulge the skirt outwardly to disengage the child-resistant elements. In some of the single skirt caps the child-resistant elements on the cap must be lifted to free it from the locking means on the container. While many of these are effective for child-resistant applications, some of them are so difficult as to require the use of both hands to actuate the child-resistant means while the container is held in some other fashion so that, after disengagement of the child-resistant locking means, the cap can be removed. This is particularly true when older children or even adults with little strength in their hands attempt to open such containers.

It is therefore the principal object of the instant invention to provide a child-resistant locking means for a "twist-action" cap, i.e., a cap having continuous threads which mate with threads on the neck of the container, a cap having discontinuous threads on the container neck, a cap having bayonet-type lugs for mating with lug-threads on the neck of the container or any other type of child-resistant cap which requires a "twist-action" to place it on the container neck as well as to remove it from the container neck in order to gain access to the contents.

DESCRIPTION OF PREFERRED EMBODIMENTS

Figure 1:
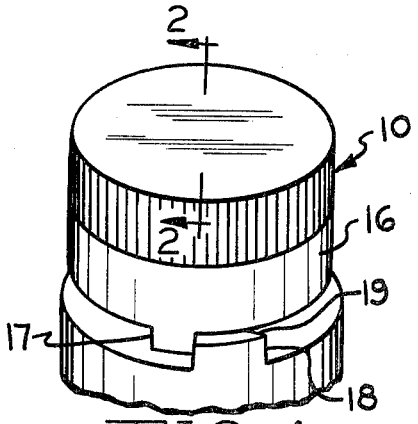
FIG. 1 is a fragmentary view in perspective of a first embodiment of the invention.
Figure 2:
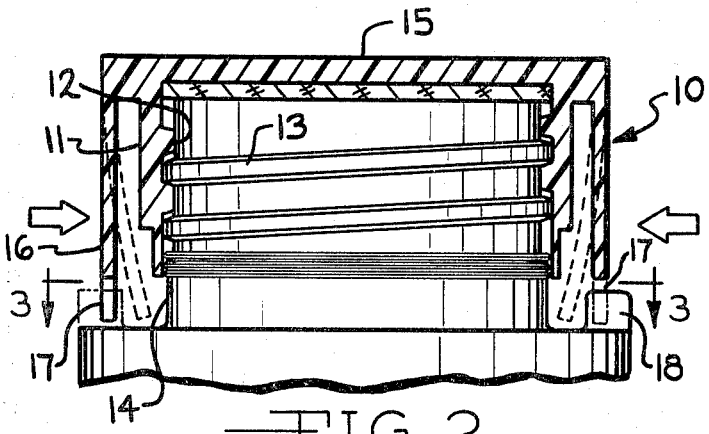
FIG. 2 is a vertical sectional view taken along the line 2—2 of FIG. 1 and shown on an enlarged scale, the child-resistant locking means being shown in engaged position.
Figure 3:
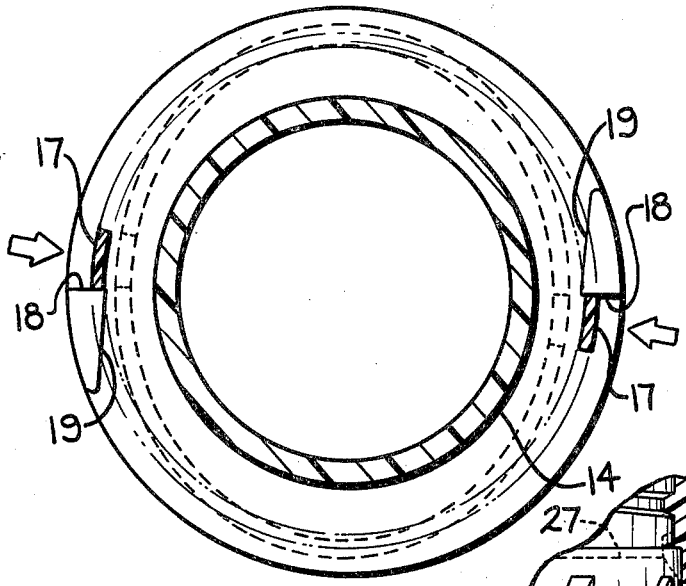
FIG. 3 is a horizontal sectional view taken along the line 3—3 of FIG. 2.

A double skirt, single piece, child-resistant cap generally indicated by the reference number 10 in FIGS. 1 – 3, inclusive, is generally of the type disclosed in U.S. Pat. No. 3,826,395 to Montgomery issued July 30, 1974. The cap has an inner threaded skirt 11 having threads 12 which mate with threads 13 on a container neck 14. The cap also has a top 15 and an outer, more flexible skirt 16.

Child-resistant locking means in this embodiment of the invention consist of depending tabs 17 which are at the lowermost edge of the outer skirt 16 and cooperating abutments 18 positioned adjacent the container neck 14 in the path of and engageable by the tabs 17 on the cap skirt 16. Each of the abutments 18 is illustrated as having a camming surface 19 which acts to cam the tabs 17 inwardly when the cap 10 is rotated to turn the cap 10 onto the container neck 14. By reason of the flexibility of the outer skirt 16, engagement of the leading edge of each of the tabs 17 with its associated camming surface 19 flexes the entire skirt 16 inwardly as illustrated in dotted lines in FIGS. 2 and 3 so that the tabs 17 pass the abutments 18.

Thus, either when the caps 10 initially are being placed upon filled containers by automatic capping equipment or when a person restores a cap 10 to a container, it can be rotated onto the container neck 14 in the conventional fashion until each tab 17 is cammed inwardly and passes its associated abutment 18 whereupon resiliency of the cap skirt 16 causes the tab 17 to snap radially outwardly into the locking position indicated in FIG. 3.

If the person replacing the cap turns it beyond the locked positon shown in FIGS. 1 – 3 in order to tightly seal the cap on the container neck 14, the child-resistant feature of the cap remains in effect and a small child seeking to remove the cap can rotate it only in retrograde direction until each tab 17 engages its abutment 18. When an older person wishes to open the container, he squeezes the skirt 16 inwardly in the direction indicated by the arrows in FIGS. 2 and 3 and can then rotate the cap 10 in a retrograde direction until each tab 17 passes its respective abutment 18.

While the cap 10 and container of FIGS. 1 – 3, inclusive, are shown as having two diametrically opposed pairs of child-resistant locking means, each consisting of a tab 17 and an abutment 18, the particular number of child-resistant locking means for any individual design is merely a matter of choice; 1 — may be sufficient, 2 — may be preferable, 3 or even 4 — might be desired for some particular problem but, of course, the use of more than 2 would render it a little more difficult to flex the skirt 16 inwardly at all points necessary to disengage the locking means.

The embodiment of the invention illustrated in FIGS. 4 – 7, inclusive, shows a single skirt cap generally indicated by the reference number 20 which has a skirt 21, on the inner side of which are formed threads 22 which mate with threads 23 on a container neck 24. This single skirt type of child-resistant cap is similar to those shown in many patents, including Gach U.S. Pat. No. 3,891,110 June 24, 1975. However, the cap illustrated in FIGS. 4 – 7 differs from the design of earlier patents in the construction of the child-resistant locking means which comprise an embodiment of the instant invention. The cap of FIGS. 4 – 7 also has a top 25. The cap and container illustrated in FIGS. 4 – 6 also comprises an inwardly directed lip 26 at the lower margin of the cap skirt 21 and an annular rim 27 on the container neck 24. The rim 27 has a generally triangular cross section so that its circular apex 27*a* has a larger diameter than the lesser diameter of lugs 26*a* forming the inwardly directed lip 26 on the cap skirt 21. Thus, when the cap 20 is turned down onto the container neck, the lugs 26*a* pass over the apex 27*a*, stretching the cap skirt 21 outwardly. This occurs before the cap 20 is in sealing position. As soon as the lugs 26*a* pass the apex 27*a*, the resiliency of the cap skirt 21 causes the lugs 26*a* to be forced inwardly, as shown in fragmentary detail in FIG. 7. This thrusts the cap 20 downwardly into seaing position, taking up the normal tolerance between the threads 22 and 23, even though the cap may not have reached the locking position.

The child-resistant locking means of this invention again comprises two cooperating elements. Near the lower edge of the cap skirt 21 there is a radially spaced web 28 connected to the cap skirt 21 by a relatively stiff ridge 29 along its leading edge and a more flexible bridge 30 at its trailing edge. The trailing edge of the web 28 has a generally vertically extending surface 31 for cooperation with an abutment generally indicated by the reference number 32, which has an opposed engaging surface 33.

Figure 4:
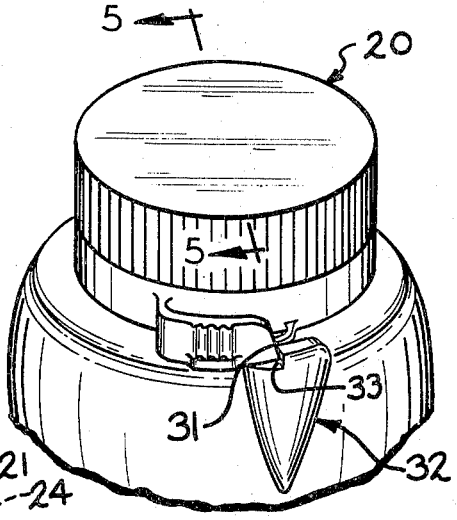
FIG. 4 is a view similar to FIG. 1 but showing a second embodiment of the invention.
Figure 7:
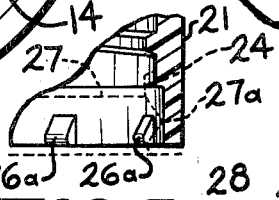
FIG. 7 is a fragmentary view taken along the line 7—7 of FIG. 6.
Figure 5:
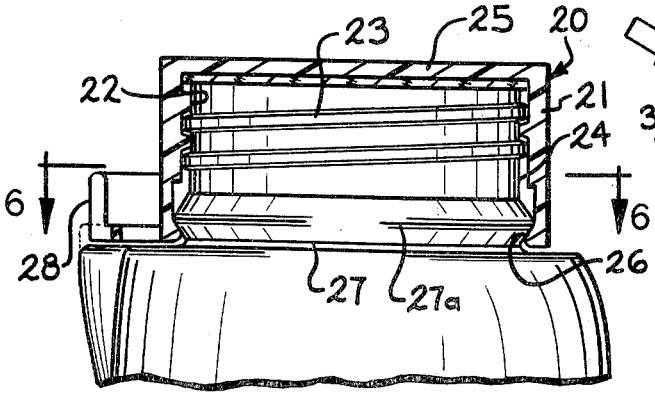
FIG. 5 is a fragmentary vertical sectional view taken along the line 505 of FIG. 4 and shown on an enlarged scale.
Figure 6:
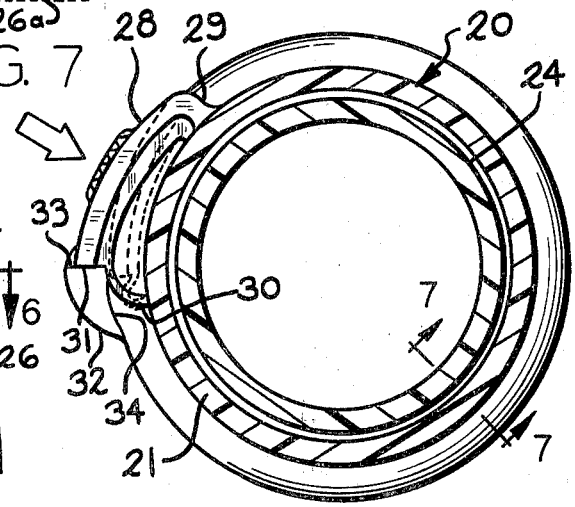
FIG. 6 is a horizontal sectional view taken along the line 6—6 of FIG. 5.

When the cap 20 is turned far enough onto the container neck 24, the outer curved corner of the leading bridge 29 engages a camming surface 34 on the abutment 32 and, as the cap 20 is further rotated, the web 28 is flexed inwardly to the dotted line position shown in FIG. 6, being held therein by the camming surface 34 until the cap 20 has been rotated at least to the position shown in FIG. 4 and in solid lines in FIG. 6. Thereafter the resiliency of the bridges 29 and 30 snaps the web 28 radially outwardly to align the vertical surface 31 with the engaging surface 33 of the abutment 32.

When an older child or an adult wishes to gain access to the contents of the container, he must squeeze inwardly against the web 28 as shown by the arrow in FIG. 6 in order to move its surface 31 inwardly of the abutment surface 33, i.e., to the dotted line positon of FIG. 6, whereupon he may rotate the cap 20 in a retrograde direction.

Again, if the cap 20 is rotated onto the container neck 24 beyond the position illustrated in FIG. 4 and 6, for example, and a child endeavors to remove the cap 20 from the container he can only turn it in a retrograde direction until the child-resistant cooperating means engage in the position illustrated in FIGS. 4 and 6.

Were it not for the cooperative action of the lugs 26*a* and apex 27*a*, as described above, such retrograde rotation of the cap 20 might well result in a leaking container because the cap 20 could move vertically due to the thread tolerances. However, in this embodiment such vertical movement is inhibited by the cooperative action just described. Not until after the child-resistant locking means 31–33 have passed each other by disengagement and further retrograde rotation of the cap 20 do the upwardly effective surfaces of the threads 22–23 act to lift the cap 20 and to pull the lugs 26*a* over the apex 27*a*.

Having described by invention, I claim

1. Child-resistant locking means for a container having a tubular neck with a neck finish for a twist-action cap, said means consisting of, a. an abutment on said container, said abutment being spaced radially outwardly from the outer side of said neck and having
   1. a face lying substantially in a radial plane of said neck and
   2. an inner side extending from the inner edge of said face in a retrograde direction and angled outwardly therefrom, and b. a deflectable tab on said cap, said tab having a portion that normally extends radially outwardly into a position of engagement with said face of said abutment and that is movable inwardly relative to said face by engagement with said inner side of said abutment when said cap is twisted onto said container neck to closed position and by manual inward deflection prior to retrograde rotation of said cap from closed position.

2. Child-resistant locking means according to claim 1 in which the tab extends axially from the cap.

3. Child-resistant locking means according to claim 1 in which the tab extends radially from the cap.

4. Child-resistant locking means according to claim 1 in which the cap has an annular skirt and the locking tab is a radial projection at the lower extremity of said skirt.

5. Child-resistant locking means according to claim 1 in which the container neck and the cap have cooperating mating threads on their outer and inner surfaces, respectively.

6. Child-resistant locking means according to claim 5 in which the cap has two concentric skirts, threads on the inner side of the inner skirt and in which the cooperating deflectable tab is on the outer skirt.

7. Child-resistant locking means according to claim 5 in which the cap has a single annular skirt and the tab is on the lower margin thereof.

8. A child-resistant closure means for a container having a threaded neck, said closure means comprising in combination, a. an inverted, generally cup-shaped cap having
   1. threads mating with the threads on said container neck,
   2. an annular skirt,
   3. a deflectable locking tab normally projecting from said skirt,
   4. a plurality of wedge-shaped lugs on the inner side of the lower portion of said skirt, said lugs having their radially thicker portions at their lower ends and defining a circle normally of a certain diameter, b. an abutment on said container that is radially spaced from the outer side of said container neck, that has a stop-face lying at least generally in a radial plane of said container neck and that is located for engagement by said tab for preventing retrograde rotation of said cap after said cap has been turned onto said container neck to a relative angular position with said tab beyond said abutment face, and c. an annular collar on said container neck having an outwardly and upwardly extending surface complementary to the surfaces of said wedge-shaped lugs and located below the threads on said container neck a distance such that said wedge-shaped lugs engage said complementary surface prior to said cap reaching the aforesaid relative angular position of engagement of said locking tab and abutment.

9. A child-resistant closure according to claim 8 in which the locking tab protrudes radially outwardly from said cap skirt.

10. A child-resistant closure according to claim 8 in which the annular collar on the container neck is of generally triangular configuration with its apex defining a circle of diameter such that such apex has an interference fit with the inner surface of said cap skirt above said wedge-shaped lugs.

* * * * *